US010581170B2

(12) United States Patent
Yang

(10) Patent No.: US 10,581,170 B2
(45) Date of Patent: Mar. 3, 2020

(54) SINGLE-LAYER PATCH ANTENNA

(71) Applicant: NovAtel Inc., Calgary (CA)

(72) Inventor: Ning Yang, Calgary (CA)

(73) Assignee: NovAtel Inc., Calgary, Alberta (CA)

( * ) Notice: Subject to any disclaimer, the term of this patent is extended or adjusted under 35 U.S.C. 154(b) by 0 days.

(21) Appl. No.: 15/637,832

(22) Filed: Jun. 29, 2017

(65) Prior Publication Data

US 2019/0006759 A1 Jan. 3, 2019

(51) Int. Cl.

| | |
|---|---|
| ***H01Q 9/04*** | (2006.01) |
| ***H01Q 1/38*** | (2006.01) |
| ***H01Q 1/36*** | (2006.01) |
| ***H01Q 21/28*** | (2006.01) |
| ***H01Q 21/30*** | (2006.01) |
| *H01Q 21/24* | (2006.01) |

(52) U.S. Cl.

CPC ..... *H01Q 9/0457* (2013.01); *H01Q 1/362* (2013.01); *H01Q 1/38* (2013.01); *H01Q 9/0421* (2013.01); *H01Q 9/0435* (2013.01); *H01Q 9/0464* (2013.01); *H01Q 21/28* (2013.01); *H01Q 21/30* (2013.01); *H01Q 9/0414* (2013.01); *H01Q 21/245* (2013.01)

(58) Field of Classification Search

CPC ..... H01Q 9/0457; H01Q 1/362; H01Q 1/38; H01Q 21/28; H01Q 21/30

See application file for complete search history.

(56) References Cited

U.S. PATENT DOCUMENTS

| | | | | |
|---|---|---|---|---|
| 6,118,406 | A | 9/2000 | Josypenko | |
| 2004/0174304 | A1* | 9/2004 | Komatsu | H01Q 1/1271 343/700 MS |
| 2008/0191953 | A1* | 8/2008 | Bruno | H01Q 1/38 343/769 |
| 2012/0032869 | A1* | 2/2012 | Hawkins | H01Q 9/045 343/857 |
| 2013/0099982 | A1* | 4/2013 | Andrenko | H01Q 5/0072 343/700 MS |
| 2015/0303576 | A1* | 10/2015 | Latrach | H01Q 1/2208 343/700 MS |
| 2016/0261035 | A1 | 9/2016 | Chamseddine | |

OTHER PUBLICATIONS

PCT Notification of Transmittal of the International Search Report and the Written Opinion of the International Searching Authority, or the Declaration, International Searching Authority, International Application No. PCT/CA2018/050274, dated May 15, 2018, 7 pages.

* cited by examiner

*Primary Examiner* — Graham P Smith
*Assistant Examiner* — Jae K Kim
(74) *Attorney, Agent, or Firm* — Cesari and McKenna, LLP

(57) ABSTRACT

A multiband microstrip antenna is provided. The antenna comprises of an inner ring radiator surrounded by an outer ring radiator on a first surface of a substrate. A feed network, on the second surface of the substrate, provides quadrature phases to feed posts to generate right hand circularly polarized (RHCP) signals.

7 Claims, 14 Drawing Sheets

| NAME | THETA | ANG | MAG |
|---|---|---|---|
| m1 | 0.0000 | 0.0000 | 6.5322 |
| m2 | -60.0000 | -60.0000 | 1.1206 |
| m3 | 0.0000 | 0.0000 | -21.8094 |

| NAME | THETA | ANG | MAG |
|---|---|---|---|
| m1 | 0.0000 | 0.0000 | 6.7401 |
| m2 | -60.0000 | -60.0000 | -0.2435 |

SINGLE-LAYER PATCH ANTENNA

BACKGROUND

It is common to utilize microstrip patch antennas in environments where a planar antenna is required. In situations that require dual band antennas, dual band microstrip patch antennas may be based on slotted patches, stacked parasitic patches, or by introducing certain reactive loadings into the structure. A uniplanar structure is usually preferred as it eases the fabrication process compared with other dual band solutions, such as a vertically stacked parasitic patch antennas. However, it is difficult to design multiband uniplanar microstrip antennas as the two microstrip radiators have to be printed on the same side of a substrate. If two rectangular (or circular) patches are used each corresponds to a different frequency and need to be placed side-by-side. This placement may generate several noted problems including, for example, occupying a large area. A further noted problem is that the two patches have different phase centers. Further, the two patches have strong couplings which reduces the gain and may further degrade the axial ratio for CP antennas.

Another prior art design is to utilize a concentric microstrip ring that surrounds a second patch center. However, this design also includes several noted disadvantages including the fact that the concentric ring has to resonate at TM11 mode, which is generally difficult to be matched to 50 ohms. Further, the radiation comes from both edges of the ring, thereby causing increased interaction with the inner radiator. Further, the surface wave bouncing inside the substrate further increases coupling between the radiators and feeds. As is known by those skilled in the art, the bandwidth of microstrip antennas is proportional to the substrate thickness and is inversely proportional to its permittivity. Antennas on thin substrates suffer from high dielectric/conductor losses. Therefore, thick substrates are generally utilized in such applications. However, the antenna efficiency decreases while thickness increases since the non-cut-off surface wave, which is generally TM0 mode wave, is prone to be excited and propagate along the grounded substrate. This wastes power as heat.

SUMMARY

The noted disadvantages described above are overcome by an exemplary multiband microstrip antenna in accordance with illustrative embodiments of the present invention. The antenna comprises a center shorted microstrip radiator configured to radiate at a first (typically higher) frequency. A microstrip ring radiator surrounds the inner radiator and is configured to radiate at a second (typically lower) frequency. The outer microstrip ring radiator is shorted to ground at one of the edges using a first metalized shorting wall. The inner radiator is therefore enclosed inside of the cavity formed of the first shorting wall which turns the inner radiator into a cavity backed antenna. The inner radiator is shorted to ground using a second shorting wall. The first shorting wall together with the second inner radiator form a cavity backed antenna with noted advantages.

Multiple feed posts are used to feed the radiators and a distribution network is placed on the back side of a substrate to provide the required power and quadrature phase to generate right hand circularly polarized (RHCP) radiation. The size of the inner radiator, the width of the outer radiator, the locations of the shorting walls, as well as the positions of the feeds may be sized to meet desired frequency characteristics. In one illustrative embodiment, these elements are configured so that the antenna is operable for dual-band reception and good impedance matching for a GNSS receiver.

BRIEF DESCRIPTION OF THE DRAWINGS

The above and further advantages of the present invention described herein in relation to the accompanying figures in which like reference numerals indicate identical or functionally similar elements, of which.

DETAILED DESCRIPTION OF AN ILLUSTRATIVE EMBODIMENT

In accordance with illustrative teachings of exemplary embodiments of the present disclosure, a uniplanar dual band antenna is provided that has high efficiency and low coupling. Illustratively, the antenna comprises of a combination of a shorted circular ring microstrip radiator at the center and a shorted ring radiator surrounding the inner radiator. To operate the peak power at zenith, both the inner and outer microstrip radiators operate at their second mode. The second mode illustratively corresponds to the lowest resonant frequency. Illustratively, this is the TM11 mode. It should be noted that while the present invention refers to circular rings, the teachings of the present invention may be utilized with square or other shaped radiators. As such, the description of ring shaped radiators should be taken as exemplary only.

Figure 1:
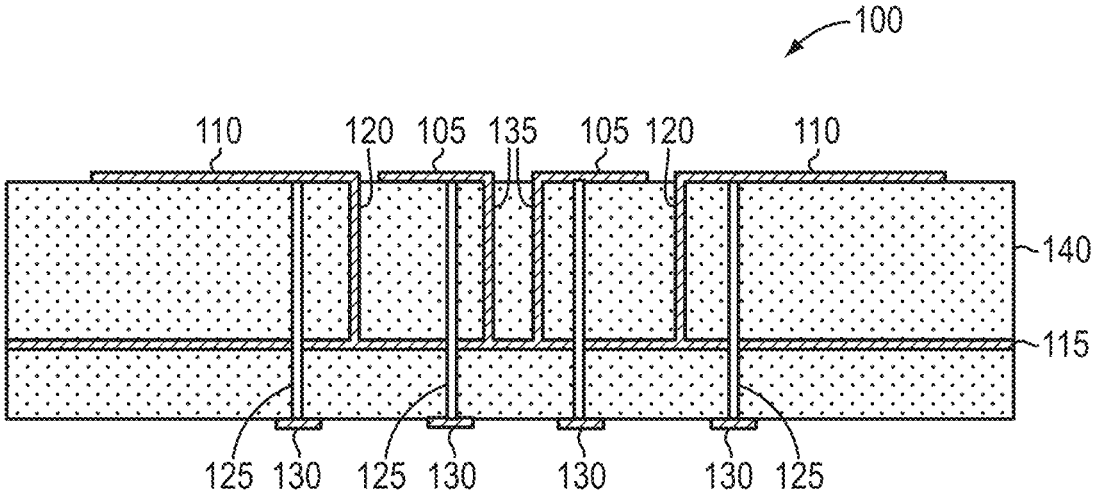
FIG. 1 is a cross-sectional view of a dual band planar antenna in accordance with an illustrative embodiment of the present invention.

FIG. 1 is a cross-section of an exemplary multiband microstrip antenna 100 in accordance with an illustrative embodiment of the present invention. A center shorted microstrip radiator 105 is provided that is surrounded by an outer microstrip ring radiator 110 and illustratively radiates at a lower frequency. The outer microstrip ring radiator 110 is shorted to ground 115 at one of the edges using a first metallized shorting wall 120.

The inner radiator 105 is therefore enclosed inside the cavity formed of the first shorting wall 120, which turns the inner radiator 105 into a cavity backed antenna. The inner radiator is shorted to ground using a second shorting wall 135. The first shorting wall 120 together with the second inner radiator form a cavity backed antenna.

To generate circularly polarized radiation, multiple feed posts 125 are used to feed the radiators and a distribution network 130 (see FIG. 3) is placed at the back side of substrate 140 to provide the required power and quadrature phases to each feed post 125 to generate right handed circularly polarized (RHCP) radiation. Illustratively, the size of the inner radiator, the width of the outer radiator, the locations of the shorting wall and the positions of the feeds are selected to provide a good impedance match to a GNSS receiver, such as a global positioning system (GPS) receiver. However, it should be noted that in alternative embodiments of the present invention, the antenna described herein may be configured for use in non-GNSS applications. As such, the description of the use of the antenna 100 in GNSS applications should be taken as exemplary only. Further, it is expressly contemplated that one skilled in the art may vary sizes, widths, and positions of various elements in order to configure an embodiment for a particular use.

Figure 2:
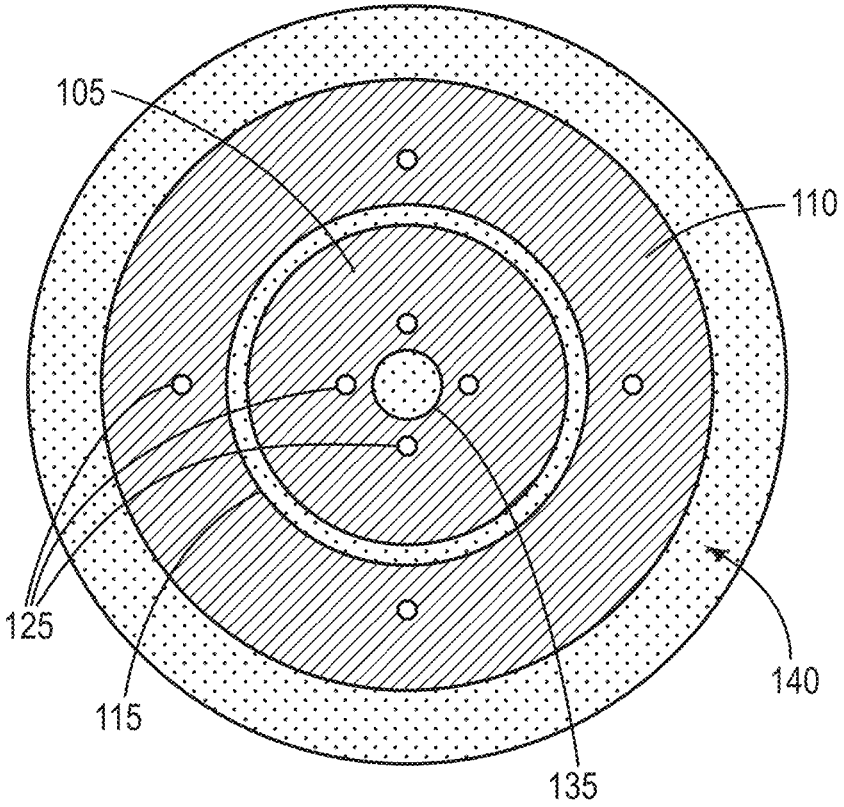
FIG. 2 is a top view of an exemplary planar antenna in accordance with an illustrative embodiment of the present invention.

FIG. 2 is a top view of an exemplary multiband microstrip antenna 100 in accordance with an illustrative embodiment of the present invention. As can be seen from FIG. 2, the antenna 100 comprises an inner radiator 105 surrounded by an outer radiator 110 layered on a substrate 140. The feed posts 125 are arranged on the inner and outer radiators 105, 110. While the antenna 100 of FIG. 2 is shown with substantially circular ring radiators, it should be noted that the teachings of the present invention may be utilized with radiators 105, 110 of varying shapes. As such, the description of radiators 105, 110 being substantially circular should be taken as exemplary only.

Figure 3:
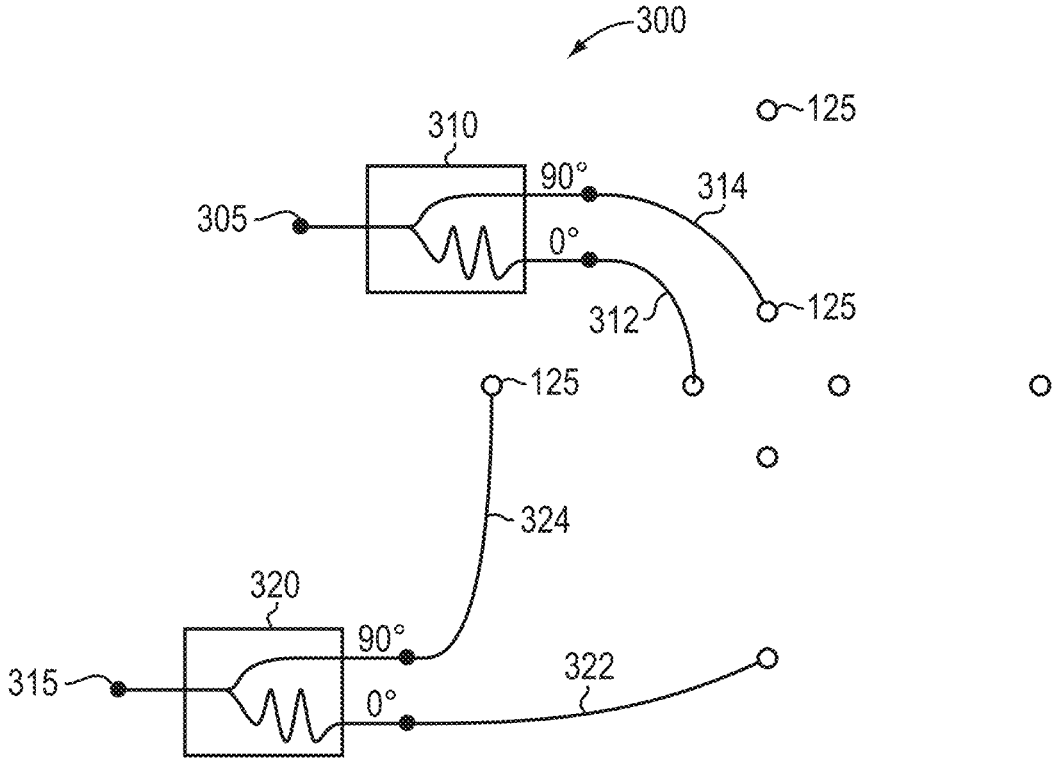
FIG. 3 is a schematic diagram of an exemplary feed system for use with a planar antenna in accordance with an illustrative embodiment of the present invention.

FIG. 3 is a schematic diagram of an exemplary feed network 300 that may be utilized with an antenna in accordance with an illustrative embodiment the present invention. A first feeding point 305 is utilized for feeding the inner radiator 105. A second feed point 315 is utilized for feeding the outer radiator 110. The first feed point 305 feeds into a phase shifter 310 that outputs two signals, namely, a 0° phase shifted signal 312 and a 90° phase shift signal 314 that are fed to feed points 125. Similarly, the second feed point 305 is fed into a phase shifter 320 that outputs a 0° phase shifted signal 322 and a 90° phase shifted signal 324 that are fed to feed points 125 for outer radiators. By utilizing such phase shifted feed signals utilizing quadrature phases, a right-handed circularly polarized (RHCP) radiation pattern may be generated by the commands. This RHCP pattern is useful for GNSS applications. It should be noted that in alternative embodiments of the present invention differing feed networks may be utilized. As such, the description of a quadrature phase feed network 300 should be taken as exemplary only.

Figure 4:
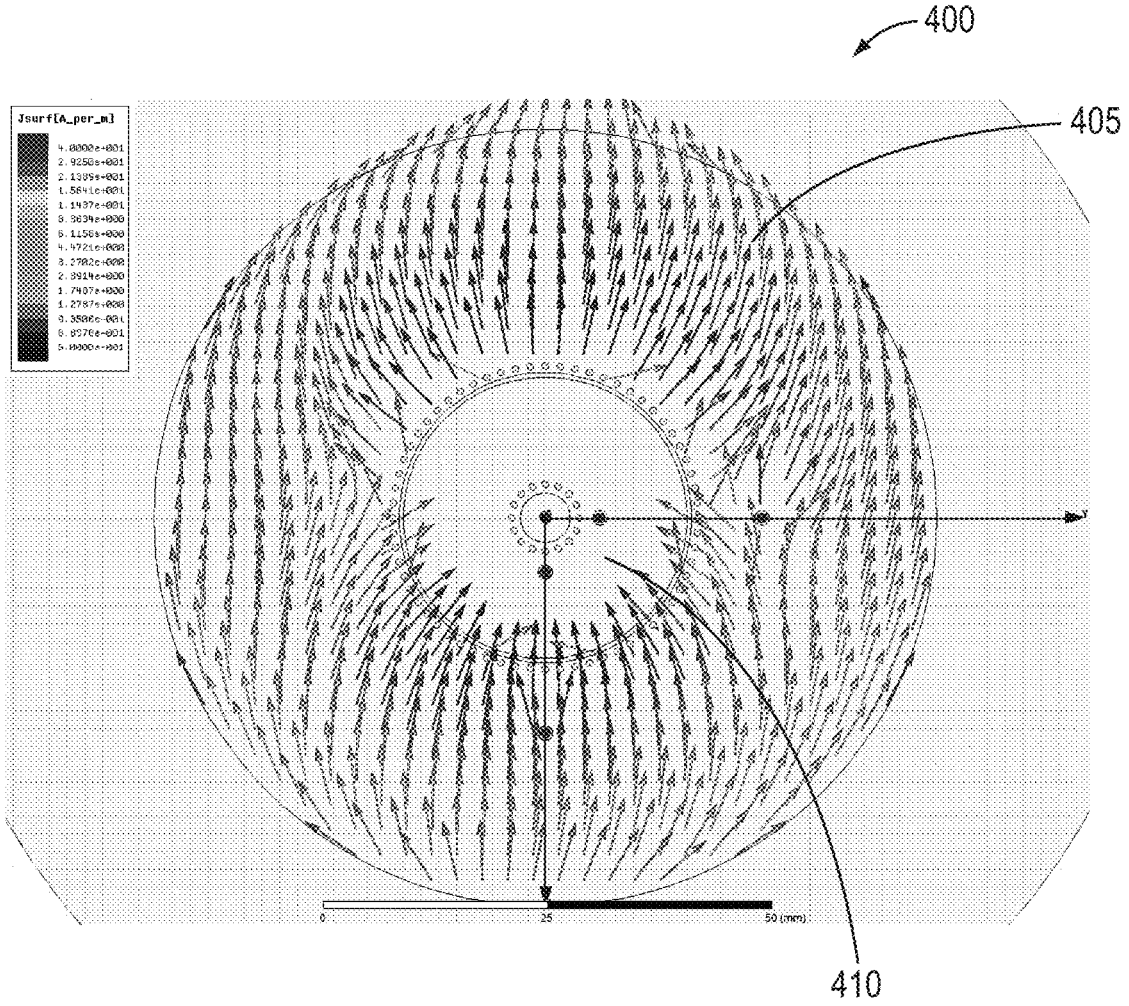
FIG. 4 is an exemplary vector current distribution diagram of the outer microstrip ring radiator in accordance with an illustrative embodiment of the present invention.
Figure 5:
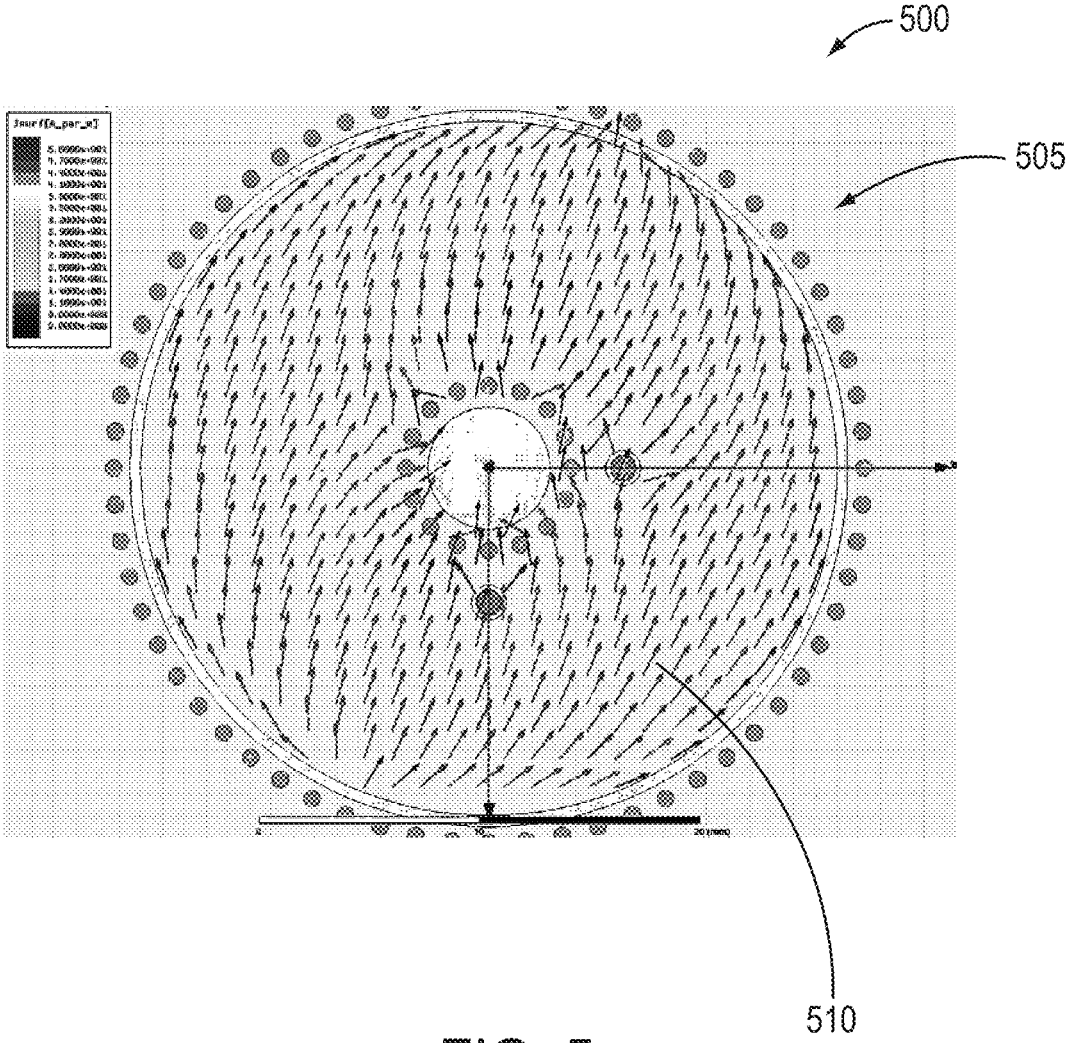
FIG. 5 is an exemplary vector current distribution diagram of the inner microstrip ring radiator in accordance with an illustrative embodiment of the present invention.

FIG. 4 is an exemplary diagram 400 illustrating the surface currents flowing on the outer microstrip ring radiator 110 in accordance with an illustrative embodiment of the present invention. Area 405 represents the outer ring 110, while area 410 represents the inner ring 105. FIG. 5 is an exemplary vector current distribution diagram 500 illustrating the inner microstrip radiator 105 in accordance with an illustrative embodiment of the present invention. Similar to that described above in relation to FIG. 4, area 505 represents the outer ring 110, while area 510 represents the inner radiator 105.

The present invention has a number of noted advantages over the prior art. A first noted advantage is that the two patch antennas are coplanar not so that they may be printed on the same side of the substrate. Further, both of the radiators radiate at broadside with similar radiation patterns. This makes the overall combined antenna 100 good for GNSS applications. Additionally, the shorted ring patch antenna has the property of surface wave suppression, which is a main cause of decreased radiation efficiency for microstrip antennas. Therefore, the shorted microstrip ring antenna has higher efficiency than its non-shorted counterparts. Additionally, the shorting metal wall together with the outer patch forms a soft surface which effectively suppresses the surface wave for the inner radiator also.

The size of the short-circuit patch can be modified by tuning the sorting position and width of the ring so that the directivity and radiation pattern may have a certain degree of freedom to be customized according to a user's desired. Additionally, the impedance match can be easily obtained by moving the shorting wall and/or feed location. Due to the metallic shorting wall, the radiation of antenna 100 mainly comes from the outer edge of the radiator. The inner radiator is enclosed inside a cavity formed of the shorting wall. The coupling between the two radiators using generally low. Illustratively, in an arrayed configuration, such as a CRPA (Controlled Radiation Pattern Antenna) application, this may improve mutual isolation among the elements of antenna 100.

Due to the forced electric shorting at the internal edge of the ring, the current flow to the surface of the radiator are rotationally symmetric, which provides a radiation pattern with a stable phase center. Another advantage of the present invention is that it has an improved multipath rejection. As is known in the art, circularly polarized antennas have a higher multipath rejection ratio. Notably, the shorting walls serve as a heat sink to improve heat dissipation and overall thermal performance of the antenna.

Figure 6:
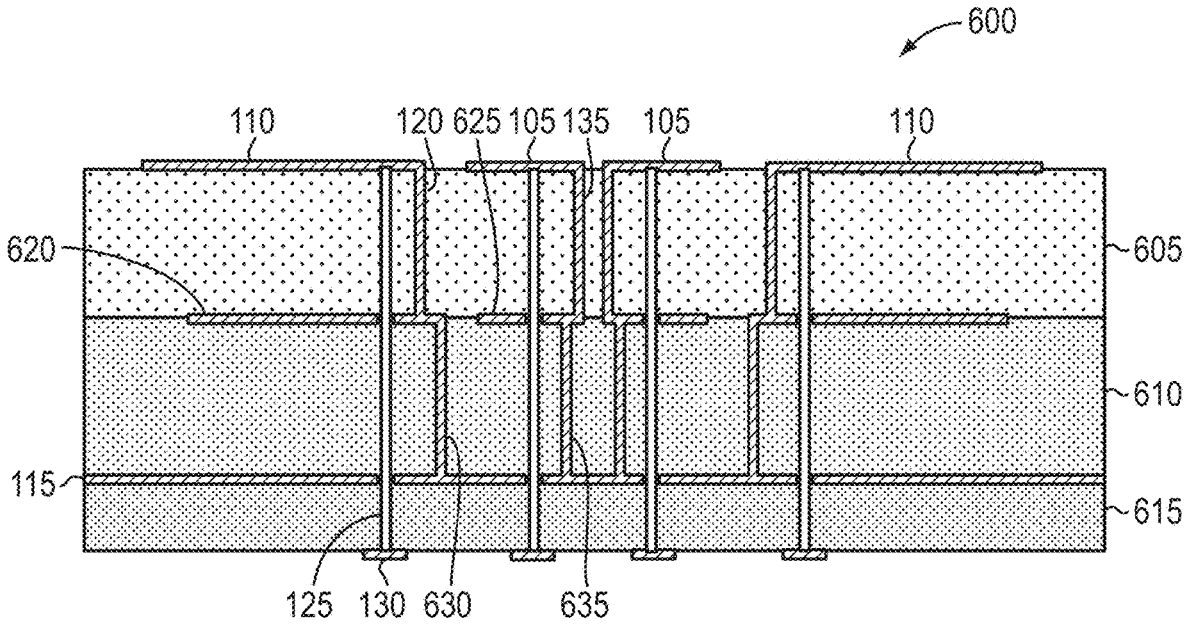
FIG. 6 is a cross-sectional view of a multi-layered substrate antenna in accordance with an illustrative embodiment of the present invention.

FIG. 6 is a cross-sectional view of a stacked microstrip ring antenna 600 utilizing a multilayer substrate in accordance with an illustrative embodiment of the present invention. The antenna is 600 comprises a plurality of substrates 605, 610, 615. It should be noted that an alternative embodiments, a differing number of substrates may be utilized. As such, a description of three substrates being utilized should be taken as exemplary only. An inner ring radiator 105 and outer ring radiator 110 are provided on a top surface of substrate 605. At the boundary point between the first 605 and second 610 substrates is a second inner radiator 625 as well as a second outer radiator 620. These have appropriate shorting connection 635 and 630, respectively. Feed lines 125 passes through ground 115 and both sets of inner and outer radiators 105, 110, 620, and 625.

The plurality of stacked microstrip radiators may correspond to different operational bands. Thus, the antenna 600 may be utilized for tri-band or even quad-band operations. Further, the teachings of the present invention may be utilized to expand the antenna 600 by layering additional substrates in a similar manner. As such, the description contained herein of two substrates being layered should be taken as exemplary only. In accordance with an illustrative embodiment of the present invention, a quad band operation may be obtained that utilizes L1/G1, L2/G2, L5 and S bands in a single antenna 600. As will be appreciated by one skilled in the art, a feeding network such as that described above, may be expanded in a similar manner to provide for appropriate right-handed circularly polarized signals from each of the radiators within antenna 600.

Figure 7:
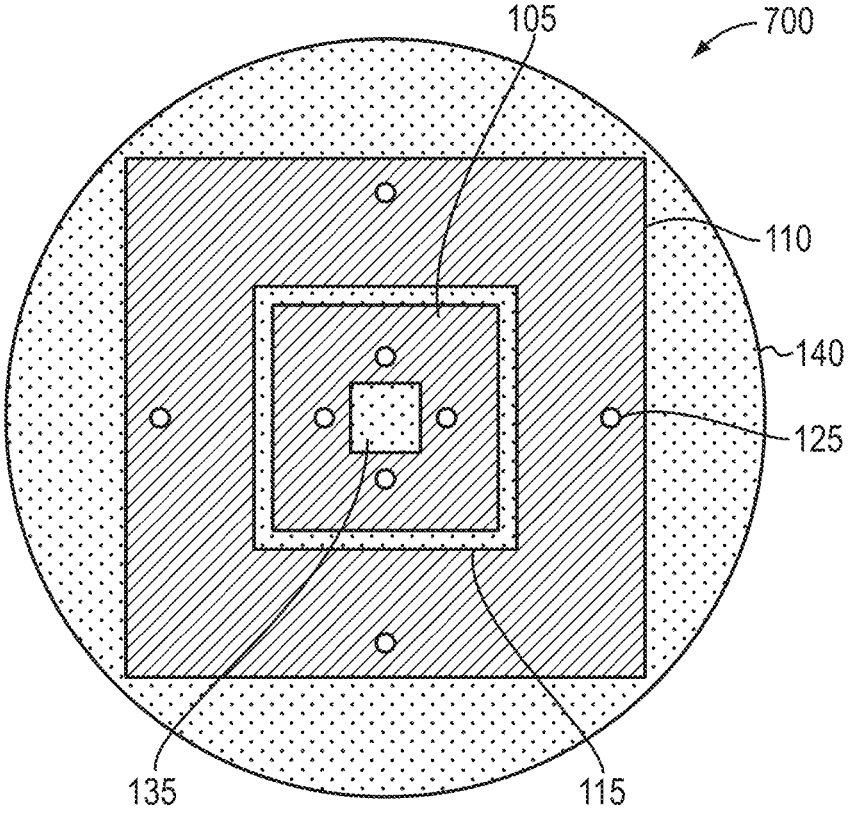
FIG. 7 is a top view of an exemplary planar antenna utilizing square rings in accordance with an illustrative embodiment of the present invention.

FIG. 7 is a top view of an exemplary antenna 700 utilizing square rings in accordance with an illustrative embodiment of the present invention. Exemplary antenna 700 illustrates that shapes other than circular arrangements may be utilized in accordance with alternative embodiments of the present invention. Exemplary substrate 140 has an inner radiator 105 arranged in a substantially square pattern and outer radiator 110 also in a substantially square pattern. Feed points 125 are arranged along the inner 105 and outer 110 radiators. As can be seen from exemplary antenna 700, the principles of the present invention may be utilized with antennas having differing geometries from substantially circular or ring shaped radiators. As such, the description of ring radiators contained herein should be taken as exemplary only.

Figure 8A:
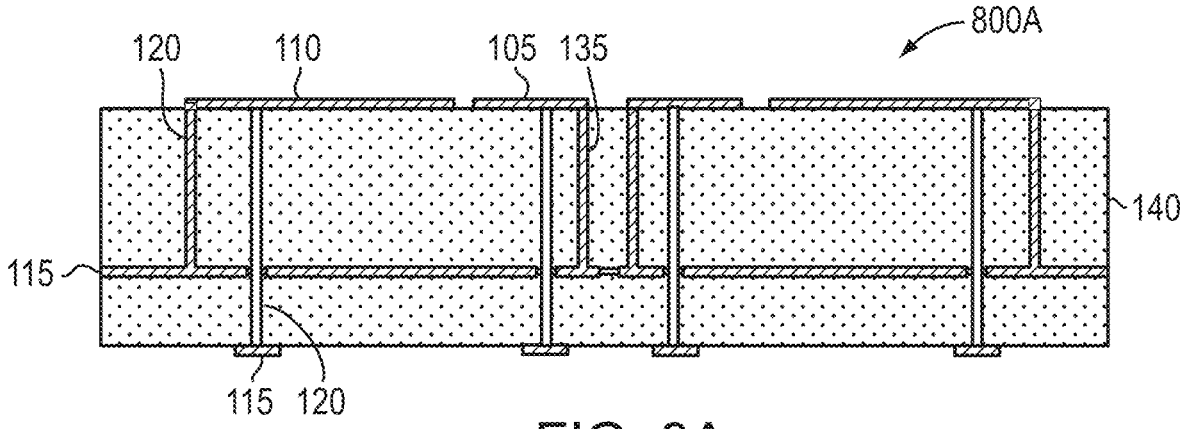
FIG. 8A is a cross-sectional view of an exemplary planar antenna in accordance with an illustrative embodiment of the present invention.
Figure 8B:
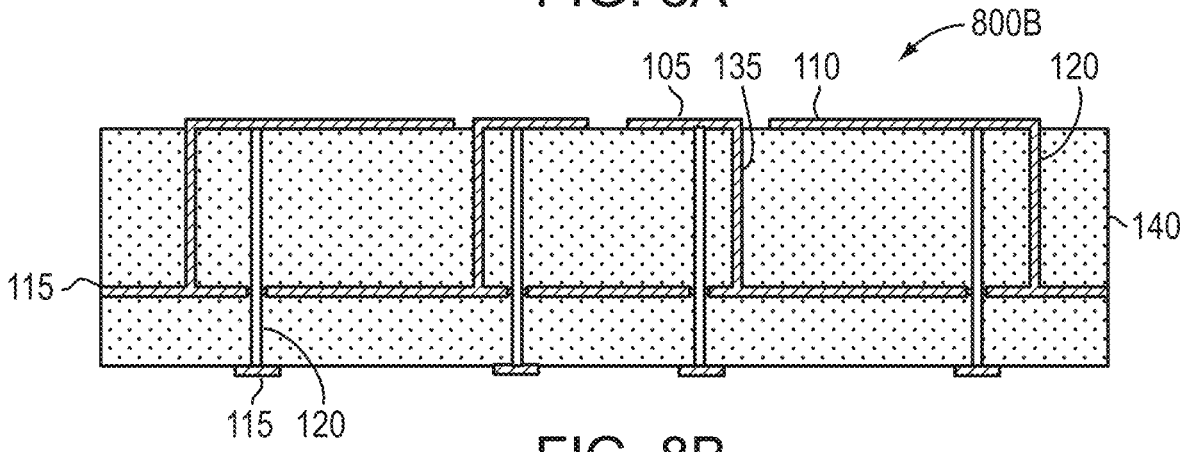
FIG. 8B is a cross-sectional view of an exemplary planar antenna in accordance with an illustrative embodiment of the present invention.
Figure 8C:
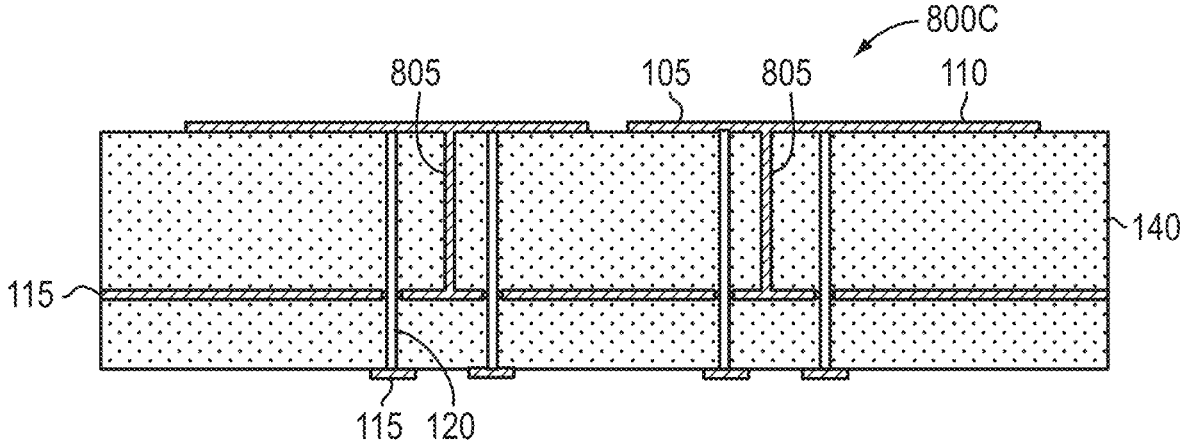
FIG. 8C is a cross-sectional view of an exemplary planar antenna in accordance with an illustrative embodiment of the present invention.

FIGS. 8A-8C illustrates variations of antenna 100 utilizing differing placement of shorting walls. It should be noted that these alternative embodiments are shown for illustrative purposes and that additional and/or differing locations of shorting walls may be utilized in accordance with the principles of the present invention. As such, the examples shown in relation to FIGS. 8A-8C should be taken as exemplary only.

FIG. 8A is an exemplary cross-sectional view of an antenna 800A showing alternative shorting wall positions in accordance with an illustrative embodiment of the present invention. Both radiators 110, 105 are inside the cavity formed by the ground 115 and the shorting wall 120, which can suppress surface waves and the back-side radiation. FIG. 8B is a cross-sectional view of an exemplary antenna 800B showing alternative shorting wall positions in accordance with an illustrative embodiment of the present invention. FIG. 8C is a cross-sectional view of an exemplary antenna showing alternative shorting wall positions in accordance with an illustrative embodiment of the present invention. The two radiators 105 and 110 share the same shorting wall and their isolation may be enhanced.

Figure 9A:
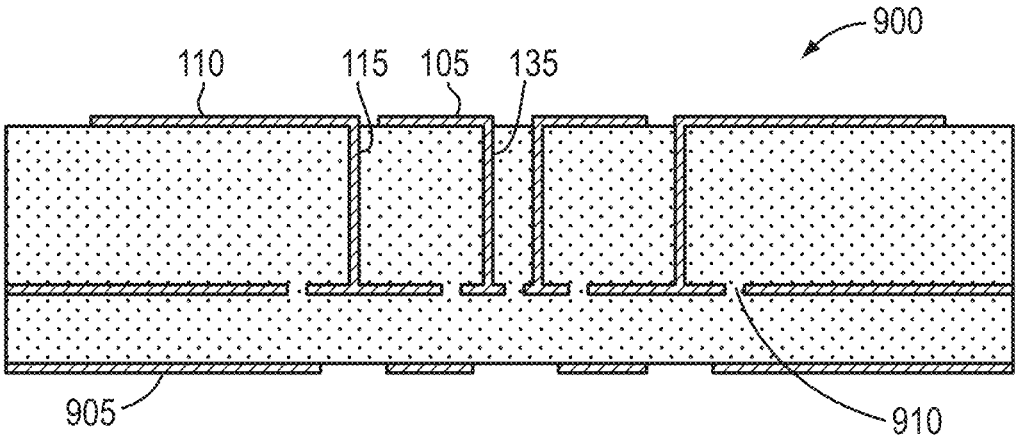
FIG. 9A is a cross-sectional view of an exemplary antenna in accordance with an illustrative embodiment of the present invention.

FIG. 9A is a cross-sectional view of an exemplary antenna 900A with an etched aperture on the ground layer that is fed through coupling of the transmission line in the aperture in accordance with an illustrative embodiment of the present invention. Exemplary antenna 900 comprises a first radiator 105 surrounded by a second radiator 110. A plurality of apertures 910 are placed within the ground. In accordance with this alternative embodiment the present invention, feed posts are not required. Instead, feeding of the antenna 900 is accomplished through the coupling of the transmission line and the apertures 910. The electromagnetic coupling through the aperture is able to enhance the impedance bandwidth of the radiator.

Figure 9B:
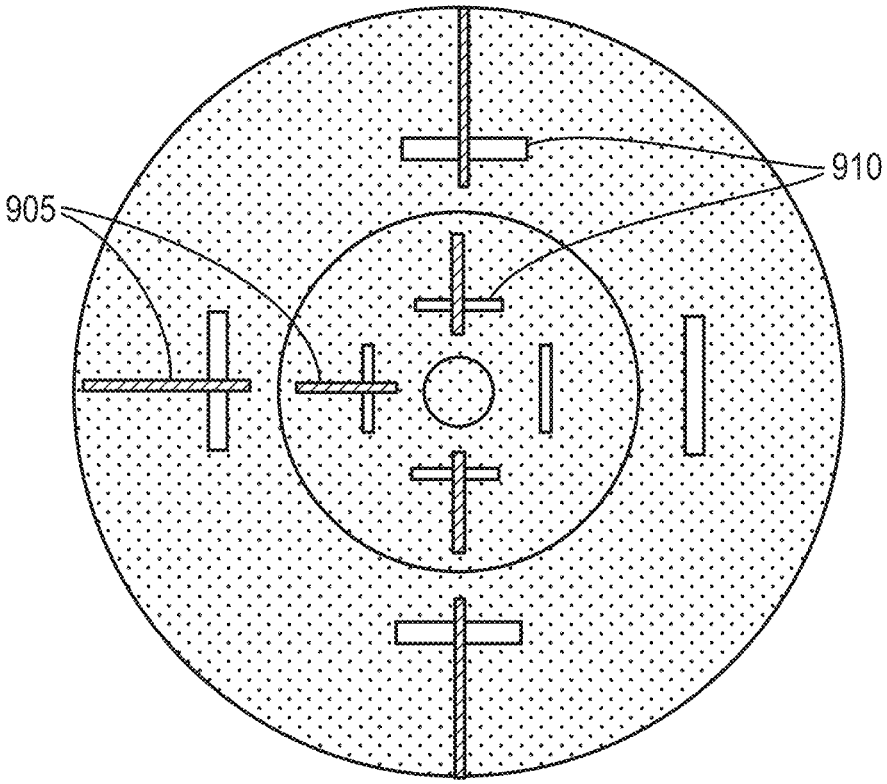
FIG. 9B is a top level view of an exemplary antenna in accordance with an illustrative embodiment of the present invention.

FIG. 9B is a top level view of an exemplary antenna 900B as described above in relation to FIG. 9A in accordance with an illustrative embodiment of the present invention. As noted above in relation to FIG. 9A, apertures 910 are located at the grounded plane that enables feeding to be accomplished without requiring a feed post as described above in relation to FIG. 1.

Figure 10:
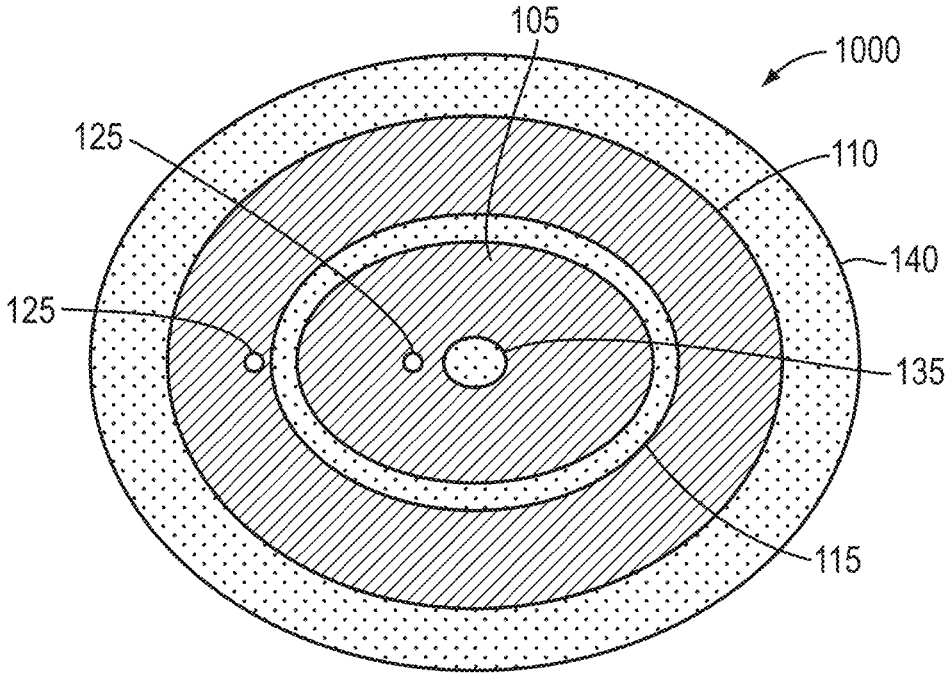
FIG. 10 is a top view of an exemplary antenna having elliptical rings in accordance with an illustrative embodiment of the present invention.

FIG. 10 is a top view of an exemplary antenna 1000 that utilizes elliptic shaped microstrip rings and single feed points in accordance with an illustrative embodiment of the present invention. Antenna 1000 includes an exemplary substrate 140 with an inner elliptical radiator 105 and an outer elliptical radiator 110 in accordance with an illustrative embodiment of the present invention. As noted above in relation to square ringed antenna 400, the principles of the present invention may be utilized with radiators of varying shapes. Antenna 1000 illustrates an exemplary elliptical ring radiator. Further, by utilizing elliptical radiators to generate two orthogonal degenerate modes, single feed posts 125 may be utilized to achieve the circularly polarized radiation. This simplifies the feeding network construction of antenna 1000.

Figure 11:
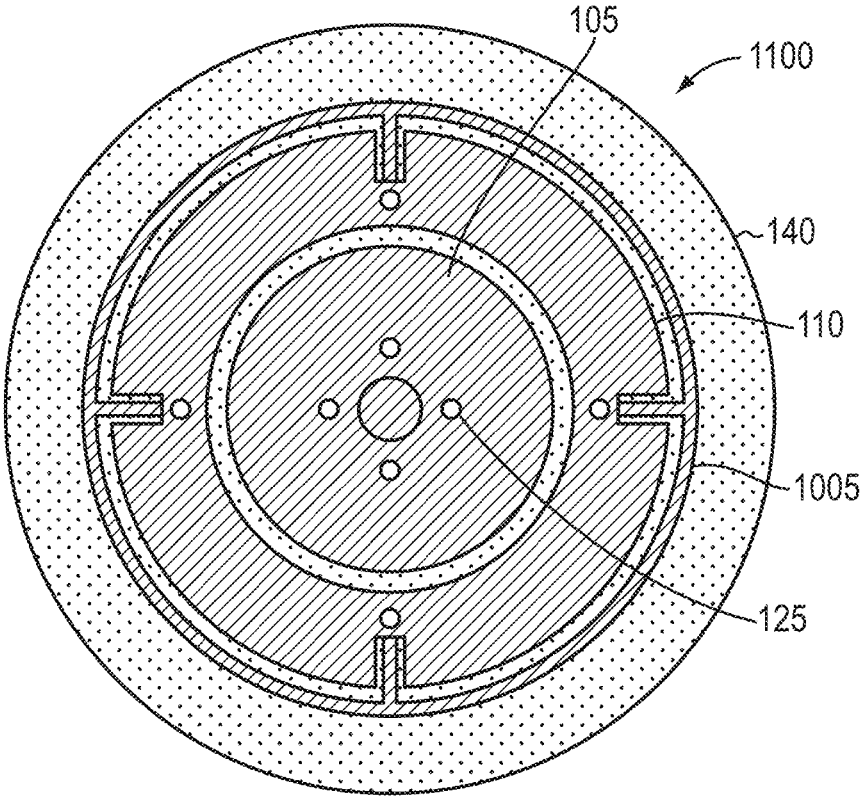
FIG. 11 is a top view of an exemplary antenna for tri-band operations in accordance with an illustrative embodiment of the present invention.

FIG. 11 is a top level view of an exemplary antenna 1100 wherein the outer ring radiator has T-stubs and slots to provide tri-band operation in accordance with an illustrative embodiment of the present invention. The outer ring radiator 1005 has a reality of T-stubs and slots at four edges. It should be noted that the description of four edges and T-stubs should be taken as exemplary only. It is expressly contemplated that in accordance with alternative embodiments of the present invention, a differing number of slots and/or T-stubs may be utilized. The exemplary antenna 1100 may be able to receive three bands of frequencies. For example, the outer radiator 110 may be able to receive the L1 and L2 frequency bands, while the inner radiator 105 receives the S band.

Figure 12:
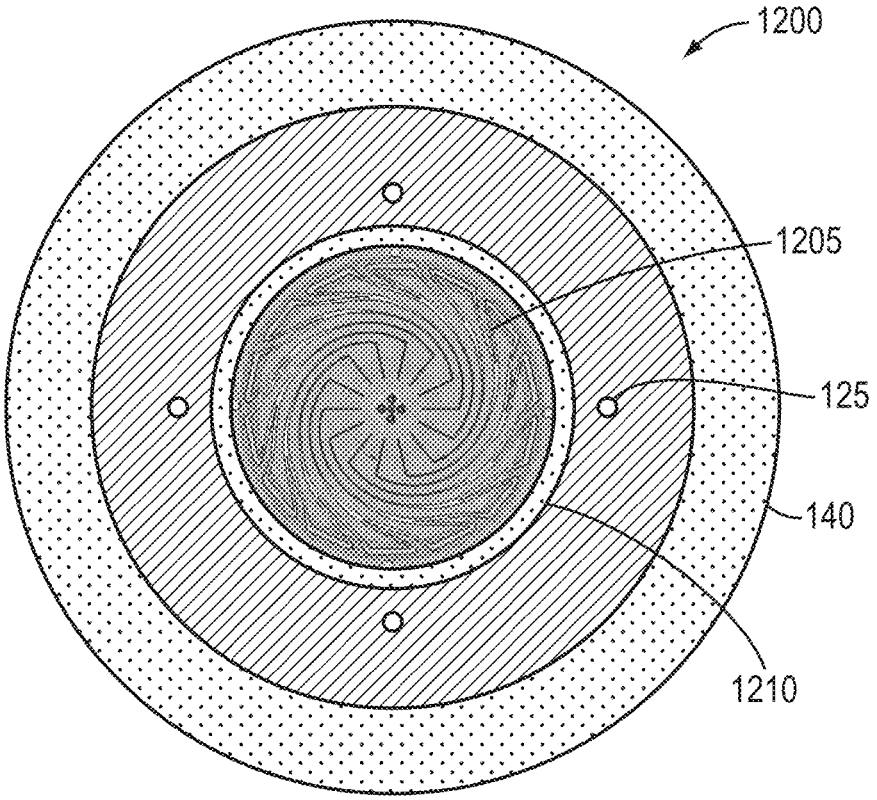
FIG. 12 is a top view of an exemplary planar antenna having an outer patch antenna and an inner pinwheel element in accordance with an illustrative embodiment of the present invention.

FIG. 12 is a top level view of an exemplary antenna 1200 that utilizes an outer shorted ring patch antenna 110 and an inner pinwheel element 1205 in accordance with an illustrative embodiment of the present invention. The exemplary pinwheel element 1205 is illustratively configured for L1/G1/S band operation, and the outer shorted ring patch is configured for L2 and L5 band operations and also provides a shorting wall and surface wave suppressions for pinwheel-elements.

Figure 13:
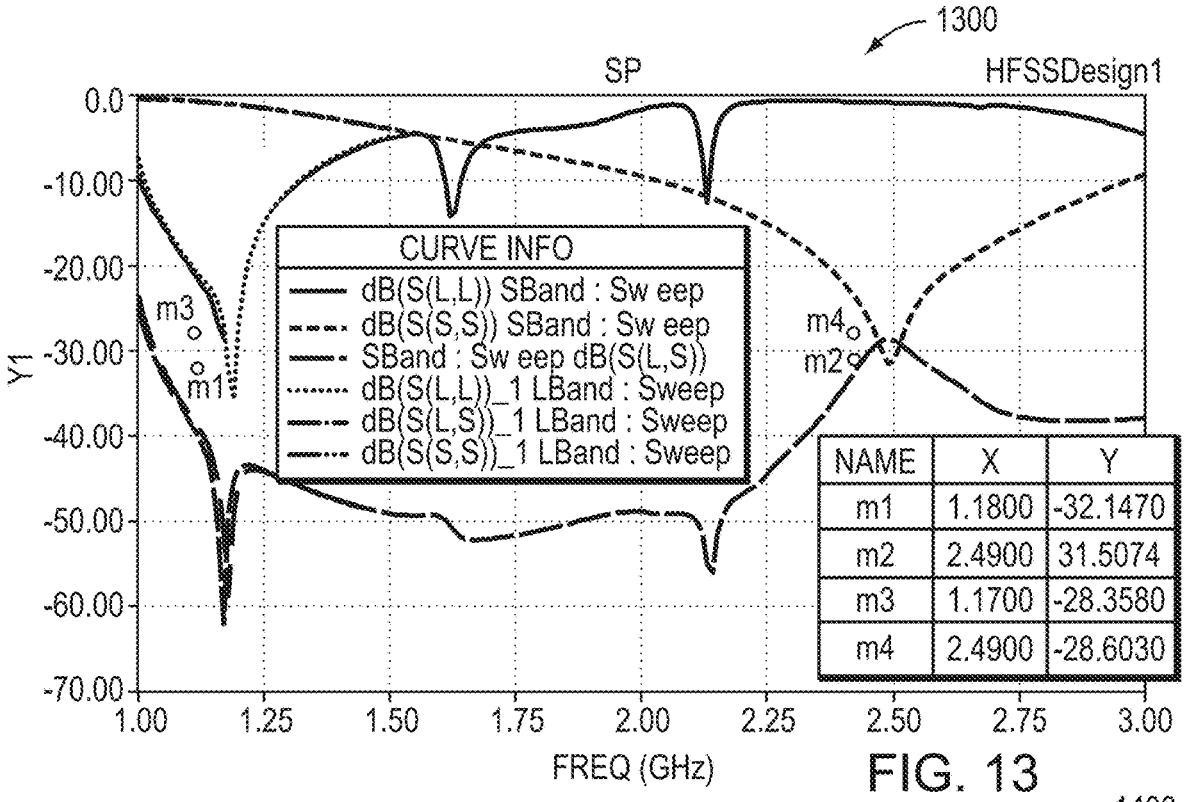
FIG. 13 is an exemplary chart showing scattering parameters versus frequency as parameters for a microstrip hybrid antenna in accordance with an illustrative embodiment of the present invention.
Figure 14:
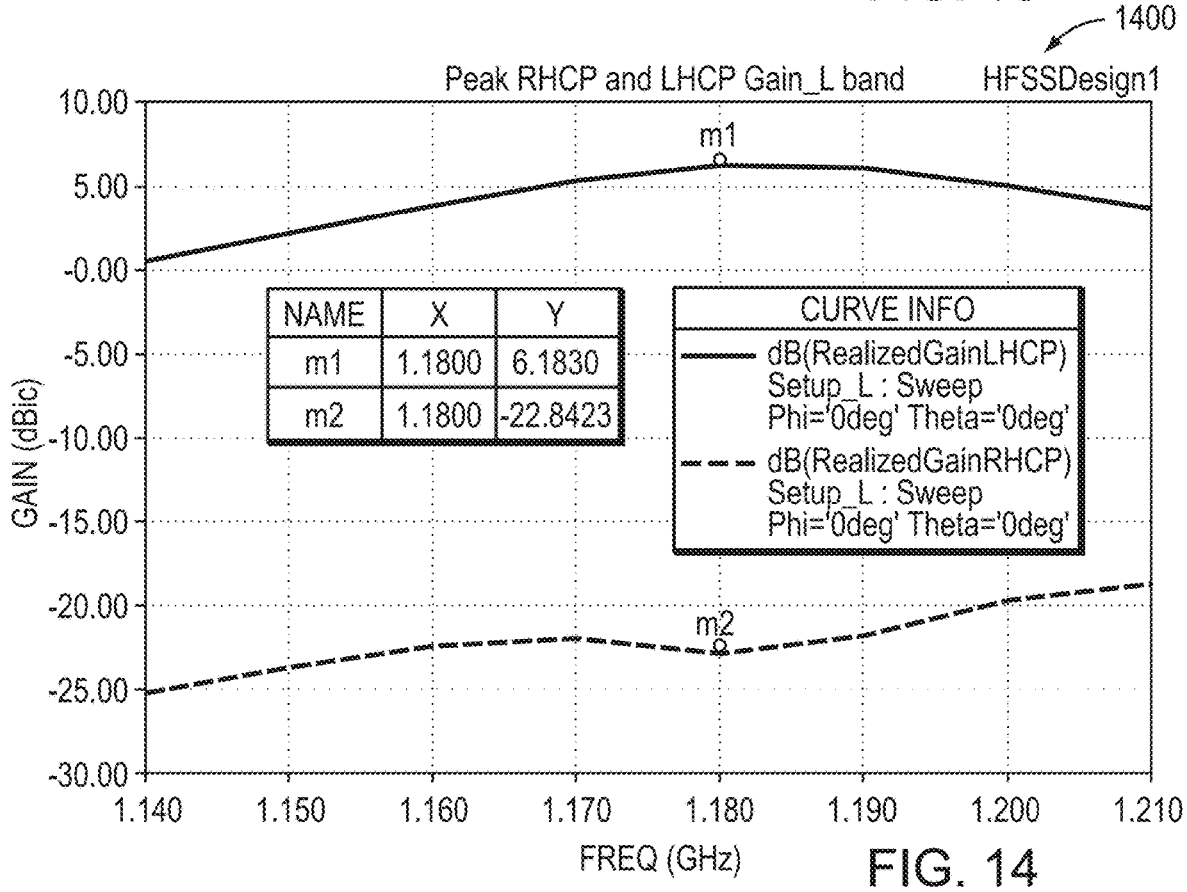
FIG. 14 is an exemplary chart displaying gain versus frequency in accordance with an illustrative embodiment of the present invention.
Figure 15:
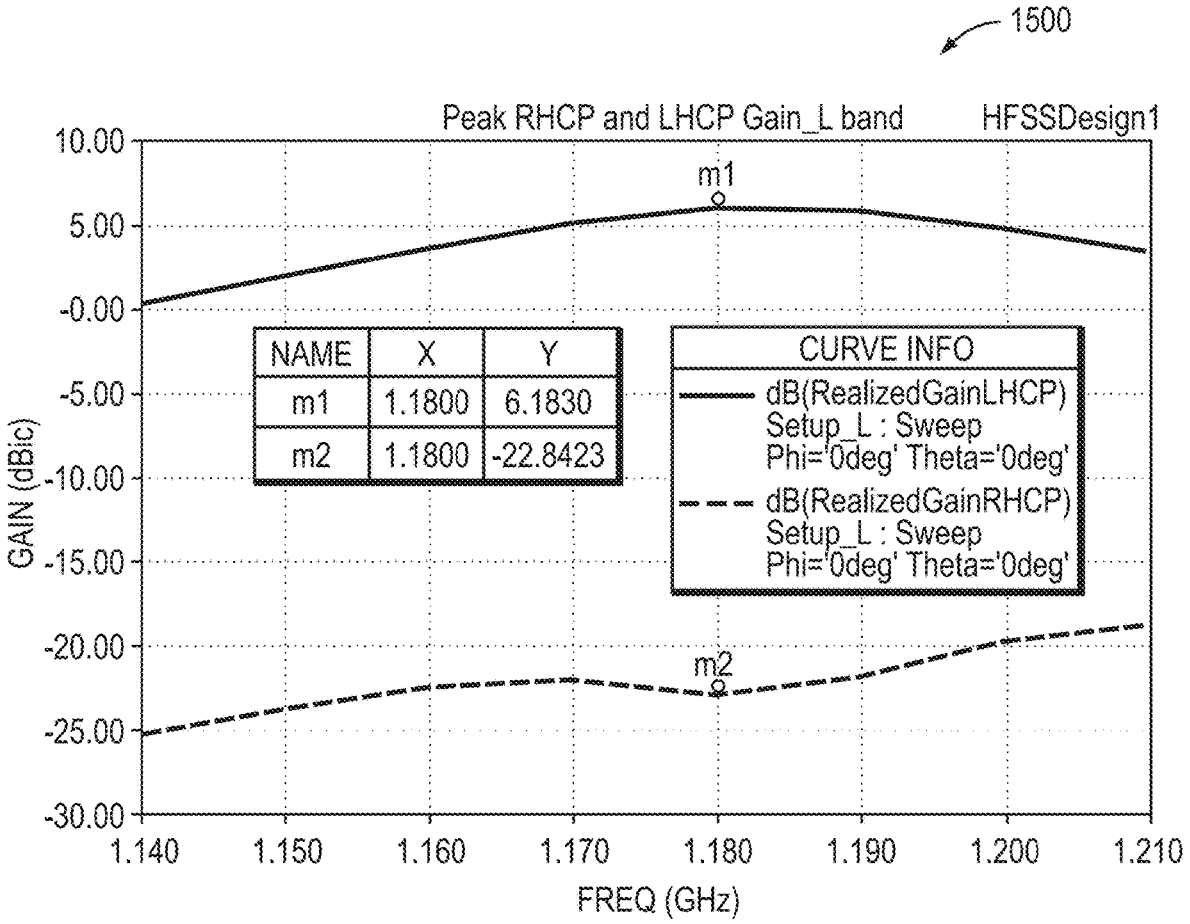
FIG. 15 is an exemplary chart illustrating gain versus frequency; in accordance with an illustrative embodiment of the present invention.
Figure 16:
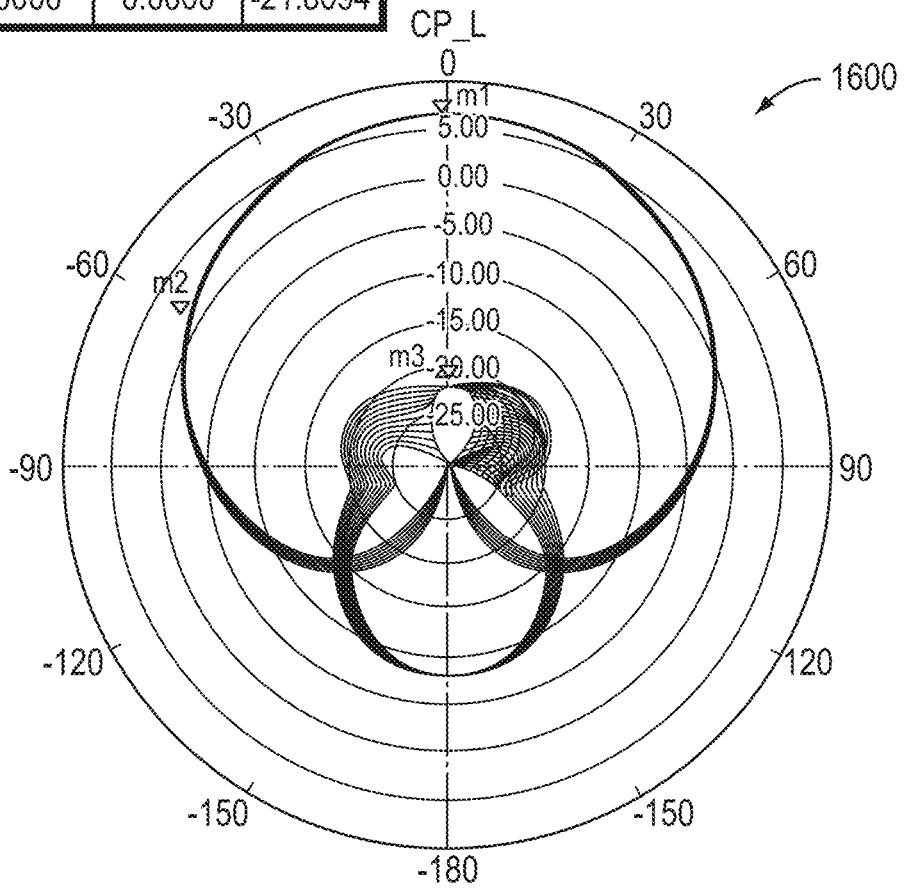
FIG. 16 is an exemplary diagram illustrating radiating patterns at the L5 band in accordance with an illustrative embodiment of the present invention.

FIG. 13 is an exemplary chart 1300 illustrating gain versus frequency in accordance with an illustrative embodiment of the present invention. The exemplary antenna operates at S-band and L5 band with good isolations between them. FIG. 14 is an exemplary chart 1400 illustrating L5 band gain versus frequency in accordance with an illustrative embodiment of the present invention. FIG. 15 is an exemplary chart 1500 illustrating S band gain versus frequency in accordance with an illustrative embodiment of the present invention. FIG. 16 is an exemplary diagram 1600 illustrating an exemplary right-hand and left-hand circular polarization radiation patterns at the L5 band when utilizing an antenna 100 in accordance with an illustrative embodiment of the present invention.

Figure 17:
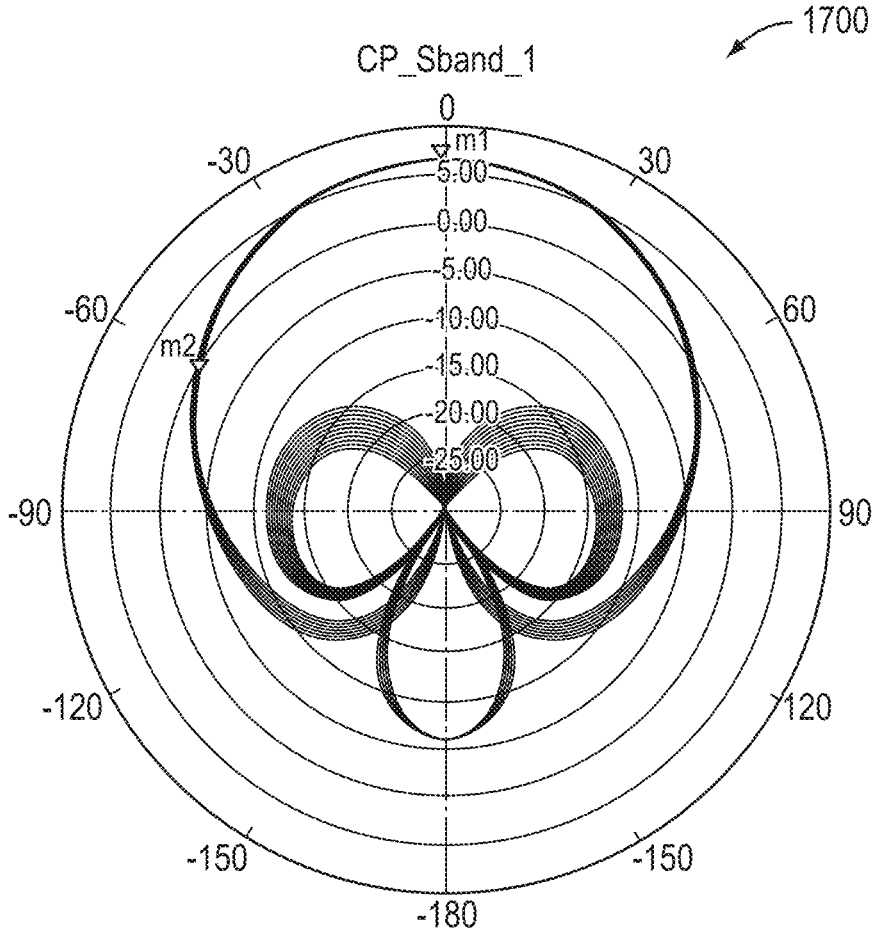
FIG. 17 is a diagram illustrating an exemplary radiation pattern at the S band utilizing an antenna in accordance with an illustrative embodiment of the present invention.

FIG. 17 is an exemplary diagram 1700 illustrating an exemplary right-hand and left-hand circular polarization radiation patterns in the S band when utilizing an antenna 100 in accordance with an exemplary embodiment of the present invention.

Various embodiments of the present invention have been disclosed. However, it is expressly contemplated that variations of the description may be utilized in accordance with the principles of the present invention. As such, the description of sizes, shapes, frequency bands, etc. should be taken as exemplary only.

What is claimed is:

1. An antenna comprising:

a first radiator located directly on a first surface of a substrate, the first radiator having an internal edge and an outer edge, the first radiator being shorted by a first shorting wall to a ground, wherein the first shorting wall is continuous and follows a shape of the internal edge of the first radiator;

a second radiator located directly on the first surface of the substrate, the second radiator having an internal edge and an outer edge, the second radiator surrounding the first radiator and being shorted by a second shorting wall to the ground, wherein the second shorting wall is continuous and follows a shape of the internal edge of the second radiator;

a feed network located on a second surface of the substrate, the feed network connected to one or more first feed posts that extend through the substrate to the first radiator, the feed network further connected to one or more second feed posts that extend through the substrate to the second radiator.

2. The antenna of claim 1 wherein the first radiator is substantially circular.

3. The antenna of claim 1 wherein the first and second radiators are elliptical in shape.

4. The antenna of claim 1 wherein the first and second radiators are substantially square in shape.

5. The antenna of claim 1 wherein the first radiator operates at a first frequency band and wherein the second radiator operates on a second frequency band.

6. The antenna of claim 5 wherein the first frequency band is higher than the second frequency band.

7. The antenna of claim 1 wherein the feed network provides quadrature phases to generate right hand circularly polarized radiation.

* * * * *